US005202659A

United States Patent [19]

DeBonte et al.

[11] Patent Number: 5,202,659

[45] Date of Patent: Apr. 13, 1993

[54] METHOD AND APPARATUS FOR SELECTIVE MULTI-RESONANT OPERATION OF AN INK JET CONTROLLING DOT SIZE

[75] Inventors: William J. DeBonte, Kent, Mass.; Stephen J. Liker, Danbury, Conn.

[73] Assignee: Dataproducts, Corporation, Woodland Hills, Calif.

[21] Appl. No.: 830,761

[22] Filed: Feb. 4, 1992

Related U.S. Application Data

[63] Continuation of Ser. No. 660,917, Feb. 27, 1991, abandoned, which is a continuation of Ser. No. 126,476, Nov. 30, 1987, abandoned, which is a continuation of Ser. No. 821,599, Nov. 23, 1986, abandoned, which is a continuation of Ser. No. 600,785, Apr. 16, 1984, abandoned.

[51] Int. Cl.[5] ..... B41J 2/045; B41J 2/205

[52] U.S. Cl. ..... 346/1.1; 346/140 R

[58] Field of Search ..... 346/1.1, 140 R

[56] References Cited

U.S. PATENT DOCUMENTS

| | | | |
|---|---|---|---|
| 1,656,338 | 1/1928 | Ranger | 346/140 |
| 3,846,800 | 11/1974 | Chen | 346/75 X |
| 3,864,696 | 2/1975 | Fischbeck | 346/140 |
| 4,104,646 | 8/1978 | Fischbeck | 346/140 |
| 4,353,079 | 10/1982 | Kawanabe | 346/140 |
| 4,383,264 | 5/1983 | Lewis | 346/140 |
| 4,459,601 | 7/1984 | Howkins | 346/140 |
| 4,503,444 | 3/1985 | Tacklind | 346/140 |
| 4,513,299 | 4/1985 | Lee | 346/140 |
| 4,523,200 | 6/1985 | Howkins | 346/1.1 |
| 4,523,201 | 6/1985 | Liker | 346/1.1 |
| 4,686,539 | 8/1987 | Schmidle | 346/1.1 |

OTHER PUBLICATIONS

Japanese Unexamined Patent Publication (Kokai) No. 53-11532, *Printing System*, Feb. 2, 1978, Sanyo Denki Kabushiki Kaisha.

Japanese Unexamined Patent Publication (Kokai) No. 55-131882, *Electronic Devices*, Oct. 14, 1980, Canon Co., Ltd.

*Primary Examiner*—Joseph W. Hartary

*Attorney, Agent, or Firm*—Woodcock Washburn Kurtz Mackiewicz & Norris

[57] ABSTRACT

The volume of ink ejected from an ink jet printing apparatus during one cycle of operation for printing a dot upon a recording medium is controlled within that cycle of operation by operating the ink jet apparatus via the application of a pulse train having a periodicity equivalent to the dominant resonant frequency of the ink jet apparatus. An electrical signal in the form of an earlier pulse train is followed by at least one additional electrical signal or pulse having a time delay and an ink jet transducer is selectively gated on or off by the electrical signals.

15 Claims, 6 Drawing Sheets

ABCDEFGHIJKLMNOPQRSTUVWXYZ
abcdefghijklmnopqrstuvwxyz
1234567890!"#$&%'()=~|{* +?<>

FIG. 11(A)

ABCDEFGHIJKLMNOPQRSTUVWXYZ
abcdefghijklmnopqrstuvwxyz
1234567890!"#$&%'()=~|{* +?<>

FIG. 11(B)

ABCDEFGHIJKLMNOPQRSTUVWXYZ
abcdefghijklmnopqrstuvwxyz
1234567890!"#$&%'()=~|{* +?<>

FIG. 11(C)

METHOD AND APPARATUS FOR SELECTIVE MULTI-RESONANT OPERATION OF AN INK JET CONTROLLING DOT SIZE

This is a continuation of application Ser. No. 660,917, filed Feb. 27, 1991, now abandoned, which is in turn a continuation of Ser. No. 126,476, filed 11/30/87, now abandoned, which is in turn a continuation of Ser. No. 821,599, filed 11/23/86, now abandoned, which is in turn a continuation of Ser. No. 600,785, filed 4/16/84, now abandoned.

The field of the present invention relates generally to ink jet apparatus, and more specifically to a method for operating an ink jet apparatus in a resonant mode for providing high resolution printing.

The design of practical ink jet devices and apparatus for producing a single droplet of ink on demand is relatively new in the art. In prior drop-on-demand ink jet apparatus, the volume of each individual ink droplet is typically dependent upon the geometry of the ink jet apparatus, the type of ink used, and the magnitude of a positive pressure developed within the ink chamber of the ink jet for ejecting an ink droplet from an associated orifice. The effective diameter and design of the orifice, the volume and configuration of the ink chamber associated with the orifice, the transducer design, and the method of coupling the transducer to the ink chamber, are other factors determining the volume of individual ink droplets ejected from the orifice. In any such ink jet apparatus high resolution imaging requires that relatively small or low volume ink droplets be ejected from the apparatus. Typically, such smaller sized ink droplets are obtained by decreasing the diameter of the orifices of the ink jet device. However, it is difficult to fabricate small diameter jet orifices, and the operation of an ink jet device incorporating such small diameter orifices is typically plagued with orifice clogging problems (by dried ink, contaminants in the ink, paper dust, etc.), adverse effects of a high ratio of surface tension forces to inertial forces, poor aim, and so forth.

Many attempts have been made to control the printing density and resolution of printing with an ink jet printer. In U.S. Pat. No. 3,977,007, issued on Aug. 24, 1976, to J. A. Burry et al, shades of gray are reproduced in an ink jet printer by selectively adjusting by one the number of drops of ink deposited at a predetermined dot location in a dot matrix. In U.S. Pat. No. 4,018,383, issued on Apr. 19, 1977 to A. D. Paton et al, a method is taught for eliminating satellite droplets in continuous ink jet system, where upon printing the method further provides for selectively eliminating or including the satellite droplets to control the density of the droplet streams. In a continuous ink jet apparatus disclosed in U.S. Pat. No. 4,047,183, issued to H. H. Taub, on Sep. 6, 1977, a laser is used to sense the frequency components of a continuous ink jet stream for controlling characteristics of a perturbation drive signal operating the apparatus, for providing the control over the formation and shape of the ink droplets comprising the ink droplet stream.

In U.S. Pat. No. 4,281,333, issued to M. Tsuzuki et al, on Jul. 28 1981, the volume or size of ink droplets ejected from a drop-on-demand ink jet apparatus are controlled merely by varying the amplitude or power envelope of the drive signal waveform used to operate the ink jet apparatus. In U.S. Pat. No. 4,337,470, issued to T. Furukawa, on Jun. 29, 1982, the dot size produced by an ink jet printer is controlled by varying the frequency of oscillation of a vibrator for vibrating ink in the ink head, for causing droplets of ink to be ejected, which droplets are electrostatically deflected onto or away from a receiving medium for controlling the density of printing. U.S. Pat. No. 4,393,384, granted to E. L. Kyser on Jul. 12, 1983, teaches a method for operating a drop-on-demand ink jet apparatus for controlling the volume and velocity of the ink droplets produced for ultimately controlling the quality of printing, whereby the control is obtained by controlably and successively first reducing the volume of the associated ink chamber, then increasing the volume, then immediately reducing the volume to an amount less than the first volume reduction, followed by an increase in the volume of the ink chamber for ejecting the ink droplet. In U.S. Pat. No. 4,493,388, issued to Y. Matsuda et al, on Jul. 12, 1983, a method of operating an ink jet device is disclosed, in which the pattern of the electrical signal applied to the transducer includes an interruption period longer than a predetermined time period followed by the time periods of three successive electrical signals, at least one of the amplitude and width of the second one of the three electrical signals being enlarged relative to the other two, for preventing a reduction in the radius of the second ink droplet ejected after the interruption period. No disclosure is made in any of the preceding briefly described patents for operating an ink jet apparatus to excite certain resonances thereof, for providing control over the size and volume of the ejected ink droplets.

In co-pending application Ser. No. 453,295, filed on Dec. 27, 1982, entitled "A Method For Operating An Ink Jet Apparatus", assigned to the same assignee as the present case, a method for operating an ink jet device in an iterative manner, for causing a plurality for successively higher, lower, or equal velocity ink droplets, or some combination thereof, to be ejected from the orifice of the ink jet, within a time period permitting the droplets to either merge in flight prior to striking a recording medium, or to each strike the recording medium near the same point, is disclosed for obtaining broader control of the boldness and shading of printing than could otherwise be obtained. Also, in co-pending patent application U.S. Ser. No. Ser. No. 600,786, filed Apr. 16, 1984, now U.S. Pat. No. 4,593,291, issued Jun. 3, 1986. entitled "Method For Operating An Ink Jet Device To Obtain High Resolution Printing", and assigned to the same assignee as the present application, a method is taught for rapidly expanding the volume of an ink chamber for pulling back into the chamber from an orifice thereof a meniscus of ink, for exciting resonances within the ink to form a cusp-shaped disturbance on the meniscus, thereby causing a relatively small droplet of ink to form and break off from the meniscus, and be ejected and propelled out of the orifice.

The present inventors discovered a method for operating an ink jet apparatus for controlling the dot size of ink printed upon a recording medium, comprising the steps of operating a transducer means for synchronously exciting either one or a combination of fluidic and mechanical resonant frequencies of the ink jet apparatus for producing a dominant resonant frequency within the ink chamber and associated ink; permitting either one of one-cycle, or one subharmonic cycle, of the dominant resonant frequency to be produced, for substantially predictably controlling the volume of an ink droplet ejected from an orifice of the apparatus via the resultant pressure disturbance produced in the associated ink chamber; and successively repeating the previous two steps a desired number of times in synchronism with the dominant resonant frequency, for producing a plurality of ink droplets within a time period permitting the droplets to merge while airborne or upon the recording medium.

In the drawing, wherein like items have common reference designations:

FIG. 11 font printouts (A) through (C), respectively, illustrates typical printout density control obtainable from operating the illustrative ink jet device using the method of the present invention.

Figure 1:
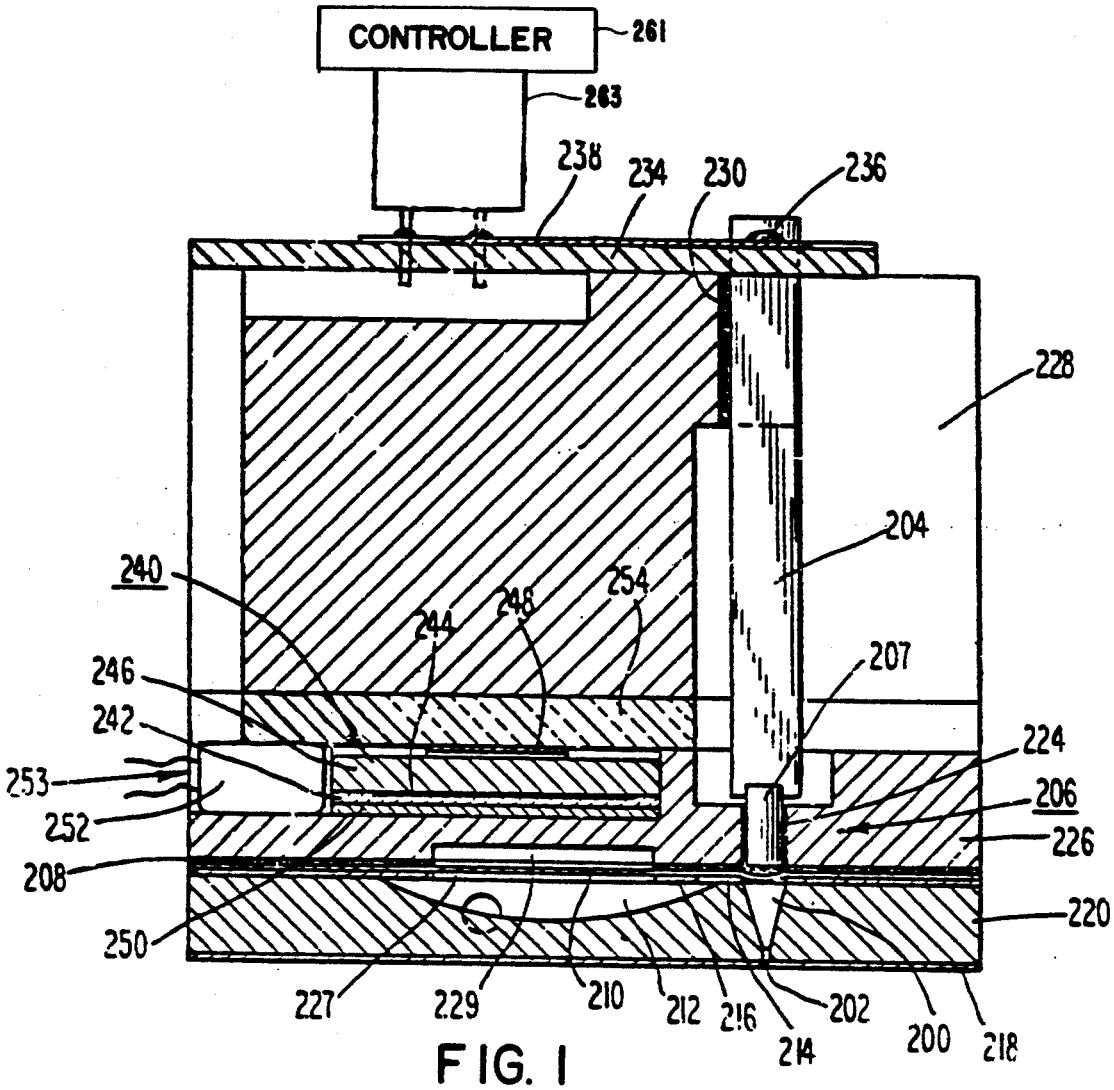
FIG. 1 is a sectional view of an illustrated ink jet apparatus.
Figure 2:
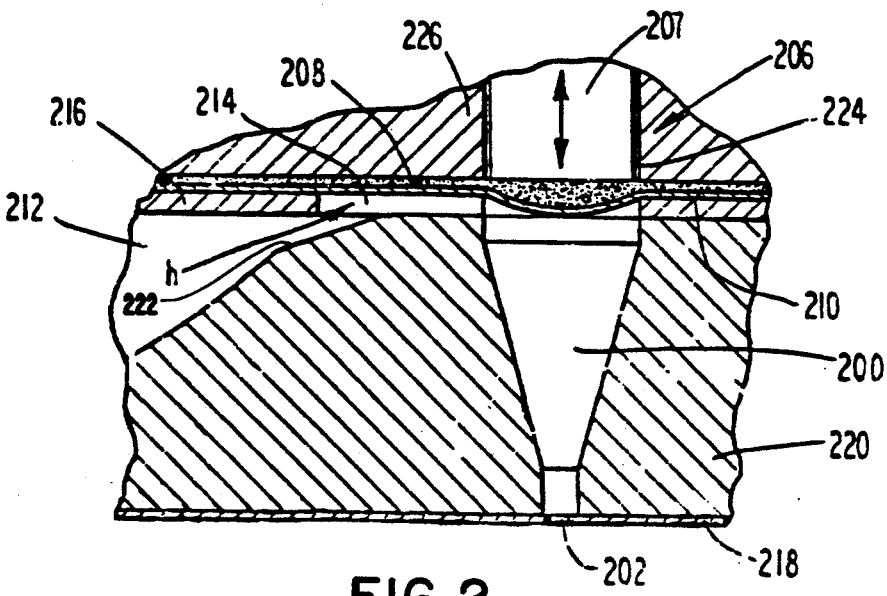
FIG. 2 is an enlarged view of a portion of section of FIG. 1.
Figure 3:
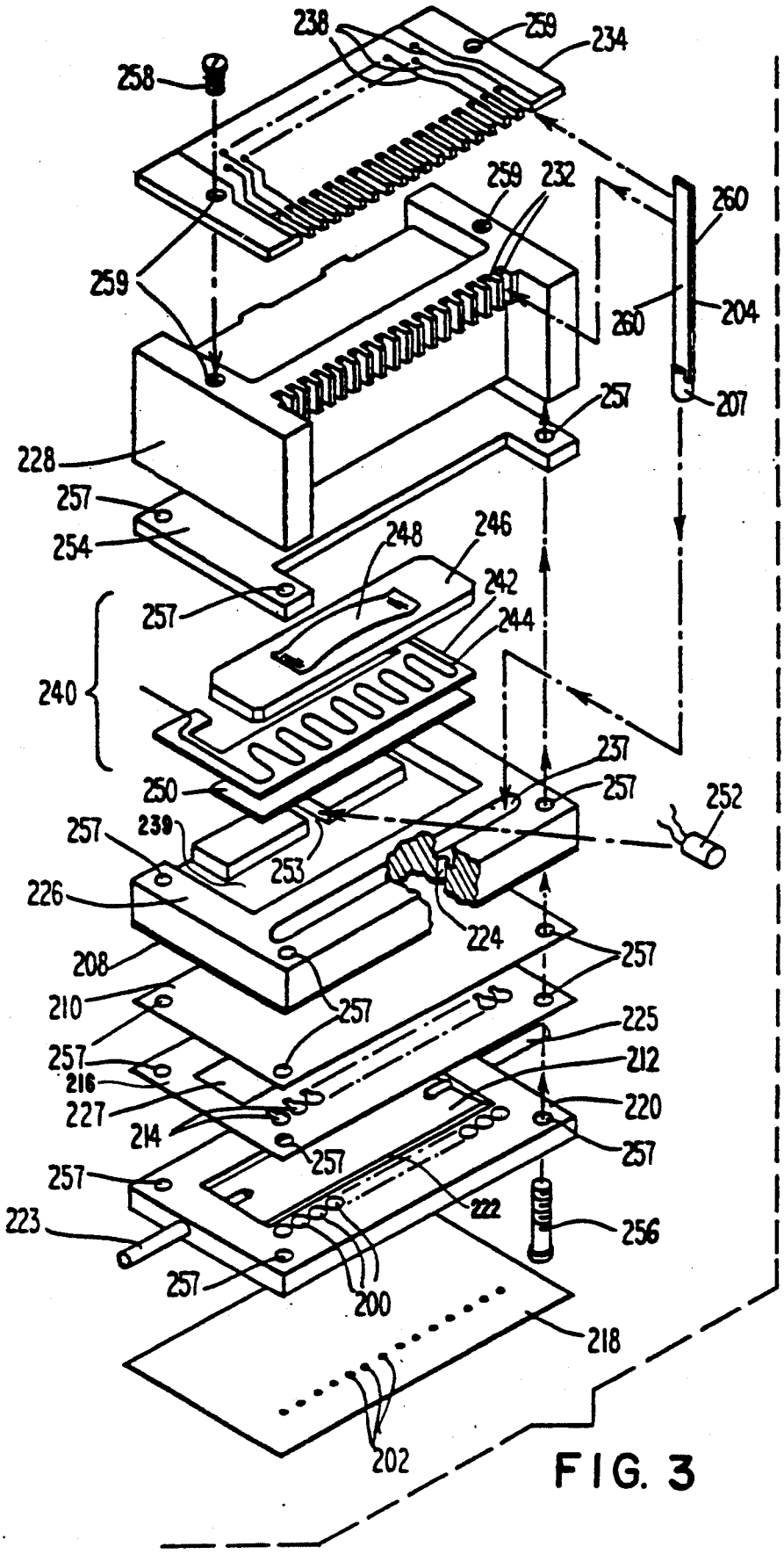
FIG. 3 is an exploded projectional or pictorial view of the ink jet apparatus, including the embodiments shown in FIGS. 1 and 2.

In FIGS. 1-3, an ink jet apparatus of co-pending application Ser. No. 336,603, filed Jan. 4, 1982, now U.S. Pat. No. 4,459,601 for "Improved Ink Jet Method and Apparatus" is shown (the invention thereof is assigned to the assignee of the present invention), and incorporated herein by reference. The present invention was discovered during development of improved methods for operating the previously mentioned ink jet for obtaining high resolution printing. However, the present inventors believe that the various embodiments of their invention illustrated and claimed herein applicable for use with a broad range of ink jet apparatus (especially drop-on-demand ink jet apparatus). Accordingly, the ink jet apparatus discussed herein is presented for purposes of illustration of the method of the present invention, and is not meant to be limiting. Also, only the basic mechanical features and operation of this apparatus are discussed in the following paragraphs, and reference is made to the previously mentioned application for greater details concerning this apparatus. The reference designations used in FIGS. 1-5 are substantially the same as used in the co-pending application, in order to facilitate any referencing back of that application or the patent that may issue therefrom.

With reference to FIGS. 1-3, the illustrative ink jet apparatus includes a chamber 200 having an orifice 202 for ejecting droplets of ink in response to the state of energization of a transducer 204 for each jet in an array of such jets (see FIG. 3). The transducer 204 expands and contracts (in directions indicated by the arrows in FIG. 2) along its axis of elongation, and the movement is coupled to the chamber 200 by coupling means 206 which includes a foot 207, a visco-elastic material 208 juxtaposed to the foot 207, and a diaphragm 210 which is preloaded to the position shown in FIGS. 1 and 2.

Ink flows into the chamber 200 from an unpressurized reservoir 212 through restricted inlet means provided by a restricted opening 214. The inlet 214 comprises an opening in a restrictor plate (see FIG. 3). As shown in FIG. 2, the reservoir 212 which is formed in a chamber plate 220 includes a tapered edge 222 leading into the inlet 214. As shown in FIG. 3, the reservoir 212 is supplied with a feed tube 223 and a vent tube 225. The reservoir 212 is compliant by virtue of the diaphragm 210, which is in communication with the ink through a large opening 227 in the restrictor plate 216 which is juxtaposed to an area of relief 229 in the plate 226.

One extremity of each one of the transducers 204 is guided by the cooperation of a foot 207 with a hole 224 in a plate 226. As shown, the feet 207 are slideably retained within the holes 224. The other extremities of each one of the transducers 204 are compliantly mounted in a block 228 by means of a compliant or elastic material 230 located in slots 232 (see FIG. 3) so as to provide support for the other extremities of the transducers 204. Electrical contact with the transducers 204 is also made in a compliant manner by means of a compliant printed circuit 234, which is electrically coupled by suitable means such as solder 236 to an electrode 260 of the transducers 204. Conductive patterns 238 are provided on the printed circuit 234.

The plate 226 (see FIGS. 1 and 3) includes holes 224 at the base of a slot 237 which receive the feet 207 of the transducers 204, as previously mentioned. The plate 226 also includes receptacle 239 for a heater sandwich 240, the latter including a heater element 242 with coils 244, a hold down plate 246, a spring 248 associated with the plate 246, and a support plate 250 located immediately beneath the heater 240. The slot 253 is for receiving a thermistor 252, the latter being used to provide monitoring of the temperature of the heater element 242. The entire heater 240 is maintained within the receptacle in the plate 226 by a cover plate 254.

As shown in FIG. 3, the variously described components of the ink jet apparatus are held together by means of screws 256 which extend upwardly through openings 257, and screws 258 which extend downwardly through openings 259, the latter to hold a printed circuit board 234 in plate on the plate 228. The dashed lines in FIG. 1 depict connections 263 to the printed circuits 238 on the printed circuit board 234. The connections 263 connect a controller 261 to the ink jet apparatus, for controlling the operation of the latter.

In conventional operation of the ink jet apparatus, the controller 261 is programmed to at an appropriate time, via its connection to the printed circuits 238, apply a voltage to a selected one or ones of the hot electrodes 260 of the transducers 204. The applied voltage causes an electric field to be produced transverse to the axis of elongation of the selected transducers 204, causing the transducers 204 to contract along their elongated axis. When a particular transducer 204 so contracts upon energization, the portion of the diaphragm 210 located below the foot 207 of the transducer 204 moves in the direction of the contracting transducer 204, thereby effectively expanding the volume of the associated chamber 200. As the volume of the particular chamber 200 is so expanded, a negative pressure is initially created within the chamber, causing ink therein to tend to move away from the associated orifice 202, while simultaneously permitting ink from the reservoir 212 to flow through the associated restricted opening or inlet 214 into the chamber 200. The amount of ink that flows into the chamber 200 during the refill is greater than the amount that flows back out through the restrictor 214 during firing. The time between refill and fire is not varied during operation of the jet thus providing a "fill before fire" cycle. Shortly thereafter, the controller 261 is programmed to remove the voltage or drive signal from the particular one or ones of the selected transducers 204, causing the transducer 204 or transducers 204 to very rapidly expand along their elongated axis, whereby via the visco-elastic material 208, and the feet 207, the transducers 204 push against the rest of the diaphragm 210 beneath them, using a rapid contraction or reduction of the volume of the associated chamber or chambers 200. In turn, this rapid reduction in the volume of the associated chambers 200, creates a pressure pulse or positive pressure disturbance within the chambers 200, causing an ink droplet to be ejected from the associated orifices 202. Note that when a selected transducer 204 is so energized, it both contracts or reduces its length and increases its thickness. However, the increase in thickness is of no consequence to the illustrated ink jet apparatus, in that the changes in length of the transducer control the operation of the individual ink jets of the array. Also note, that with present technology, by energizing the transducers for contraction along their elongated axis, accelerated aging of the transducers 204 is avoided, and in extreme cases, depolarization is also avoided.

As previously mentioned, the present inventors recognized that it is known that droplet size produced by an impulse ink jet printer is closely coupled to the orifice size of the associated ink jet device, and that only small variations in droplet size can generally be produced by varying the drive voltage amplitude or waveform, for example. They further recognized that for high quality half-tone printing, the droplet size must be controllable over a wide range. They also recognized that for certain inks, which do not spread widely on paper, such as a wax base inks, for example, it is necessary to produce larger ink droplets for obtaining desired print dot diameters than can be readily achieved by the present methods of operating ink jet apparatus.

Figure 12:
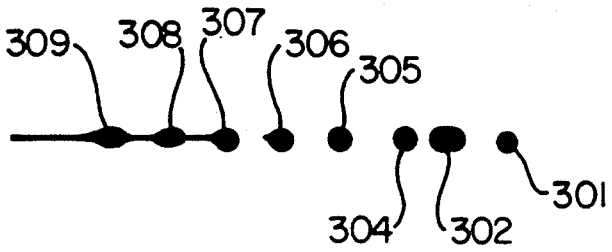
FIG. 12 shows droplets in flight produced using the present method.

In operating the illustrative ink jet device previously described herein, the present inventors discovered that by synchronously exciting either one or a combination of the fluidic and mechanical resonant frequencies of the ink jet apparatus for producing a dominant resonant frequency disturbance within the associated ink chamber and ink, permitting either one of one-cycle, or one subharmonic cycle of the dominant resonant frequency to be produced that the volume of ink droplets ejected is controllable. They further discovered that by repeating operation in an iterative or successive manner with each repetition cycle being in synchronism with the dominant resonant frequency of the ink jet apparatus, a plurality of ink droplets can be ejected within a time period permitting the droplets to merge while airborne or upon the recording medium, thereby permitting substantial control over the resultant dot size upon the recording medium relative to the dot size obtained from a single droplet of ink. The resultant dot size is dependent upon the number of times within a given time period that the inventive method of operation is repeated. FIG. 12 shows nine droplets 301-309 in flight for producing a dot on a recording medium using the method of the present invention.

The present inventors further discovered that for the illustrative ink jet device of this example, that the Helmholtz resonant frequency is the dominant resonant frequency of the subject ink jet device. Other ink jet apparatus, which may also be operated using the method of the present invention, may have some other resonant frequency other than the Helmholtz as the dominant resonant frequency. For the purposes of further describing and illustrating the method of operation of the subject invention, it is assumed that the Helmholtz resonant frequency is the dominant resonant frequency, but such assumption is not meant to be limiting or restrictive as to the scope and use of the present invention.

The present method is a multipulse method of operating an ink jet apparatus, utilizing the dominant resonant frequency of the ink jet device to produce droplets of ink of controllable volume through pulsation of the transducer 204 (in this example) at a repetition rate of the dominant resonant frequency using either a single, or a plurality of a pulses at the dominant resonant frequency, dependent upon the dot size required. Where the Helmholtz frequency is the dominant frequency, this frequency results from an interaction of the ink chamber 200 (in this example) compliance, and the ink or fluid inertance expressed by the formula:

$$F_H = \frac{1}{2\pi}\left(\frac{1}{\sqrt{LC}}\right)$$

where C equals the ink chamber compliance, L is equal to the inertance and I/L equals [I/L orifice +I/L restrictor 214 (for example)].

Figure 4:
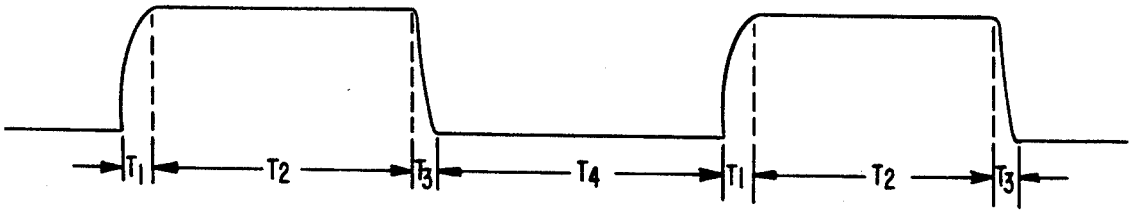
FIG. 4 shows the waveshape for electrical pulses of a preferred embodiment.
Figure 5:
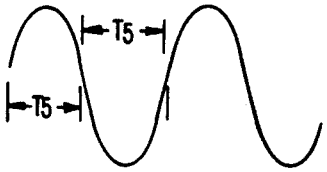
FIG. 5 shows a sinusoidal waveshape for electrical drive signals of another embodiment of the invention.
Figure 6:
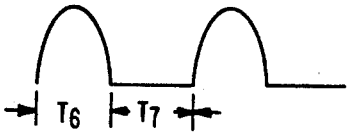
FIG. 6 shows a half-wave sinusoidal waveform for a third embodiment of the invention.

Through laboratory test and analysis, it was determined that the illustrative ink jet apparatus has a Helmholtz frequency of approximately 30 kHz. In reference to FIG. 4, the substantially rectangular or square wave pulses shown were used to operate the illustrative ink jet device in accordance with the method of the present invention. The pulse characteristics for this particular waveform found to provide substantial control over the size of the ejected ink droplet for the various time periods shown were discovered to be: $T_1=1.0$ microsecond pulse time, $T_2=13.0$ microseconds pulse time, $T_3=1.0$ microsecond fall time, and the dead time $T_4=15.0$ microseconds, thereby providing a pulse repetition frequency close to the 30 kHz Helmholtz dominant resonant frequency of the illustrative device. Note that the dead time $T_4$, in this example, is required to lock the drive signal applied to a transducer 204 in phase with the natural oscillation of the ink fluid contained within the ink chamber 200. The inventors determined that by applying two pulses as shown in FIG. 4 to a transducer 204, that the volume of the ultimate ink droplet ejected was approximately twice the volume obtained in using a single one of the pulses over the same period of time that the two pulses were applied. It was further determined that the droplet volume appeared to increase linearly in direct correspondence with the number of such pulses applied to the transducer 204. By applying two or more pulses of appropriate amplitude having the waveshapes as shown in FIG. 4 and characteristics as previously described, it was further determined that this multipulsing method resulted in a merging of the ink droplets in flight, or upon striking the recording medium, resulting in an increased dot size upon the recording medium compared to using a single pulse for producing such a dot upon the medium.

Note that the waveform of FIG. 4, and the waveforms of FIGS. 5–9, to be described later, can be obtained under laboratory testing conditions from a commercial waveform generator. However, in a practical device, controller 261, for example, must be specifically designed or programmed to produce the desired waveforms and number of pulses required for producing a given size dot on a recording medium.

Tests conducted by the inventors demonstrated that the illustrative device, having a Helmholtz frequency of 30 kHz, as previously mentioned, is operable using any combination of pulsewidth $T_2$ and dead time $T_4$ ranging from 8.0 microseconds to 16.0 microseconds, with the rise and fall times $T_1$, $T_3$, respectively, set at one microsecond, for example. The lower limit of this range is determined by the reaction time of the transducer(s) 204, whereas the upper limit of this range is determined by the ink jet device configuration limiting the effectiveness of driving or operating the device at or near its Helmholtz frequency. The complexity of the electronic design of the controller 261 is reduced when the waveform of the driving pulses such as in FIG. 4 are substantially as shown with the total pulsewidth $(T_1+T_2+T_3)$ and dead time $T_4$ being substantially equal in duration. Also, optimum operation of the illustrative ink jet apparatus was obtained when the total periodicity of the pulse train $(T_1+T_2+T_3+T_4)$ is made substantially equal to the reciprocal of the dominant resonant frequency, in this example $1/F_H$. It was further determined that the limitations on the reaction time of the transducer 204, coupled with the relatively high frequency of the dominant resonant frequency mode of driving or operating the ink jet apparatus using the multipulse method of this invention, that many other different waveshapes other than those of FIG. 4, but having similar periodicity can be used. For example, other waveshapes found to give satisfactory control over the dot size using the method of the present invention included a sinewave, a half-sinewave, a quarter-sinewave, a sawtooth waveform and a triangular waveform, as shown in FIGS. 5–9 respectively. In using such alternative waveforms to operate the illustrative device, as previously mentioned, the 30 kHz Helmholtz frequency of the device was determined to be the dominant frequency. Accordingly, for the sinusoidal waveform of FIG. 5, $\frac{1}{2}$ $T_5$ can be substantially made equal to 30 kHz. Similarly, for the half-wave sinusoidal waveform of FIG. 6, the pulse time $T_6$ and dead time $T_7$ should equal about 15 microseconds. Similar comments can be made for the pulse times $T_8$, $T_{10}$, $T_{12}$, of FIGS. 7–9 respectively, and of the dead time $T_9$, $T_{11}$ and $T_{13}$, of FIGS. 7–9, respectively.

From the various pulse shapes or waveforms tested, it was discovered that the rectangular or square waveform, due apparently to having fast rise and fall times, can be utilized at a much lower pulse voltage amplitude than any other waveforms tested such as those of FIGS. 5–9, for example. In fact, it was determined that the quarter-wave sinusoidal waveform of FIG. 7 required pulses of 20% greater amplitude than the substantially square or rectangular pulses of FIG. 4 for obtaining equivalent printing operation from the illustrated ink jet device. Also, as previously mentioned, the waveform of FIG. 4 generally is much easier to provide electronically relative to the other waveforms of FIGS. 5–9, and yet other different waveforms.

It was further discovered in testing the method of the present invention and operating the illustrative ink jet device, that due to the dominance of the Helmholtz frequency in the device tested, that the multipulsing method of the present invention can also be provided by basing the periodicity of the driving pulses upon subharmonic cycles of the Helmholtz frequency. It is believed that the same result would be obtained for the dominant resonant frequency of some other ink jet device, had it been tested using the method of the present invention. However, using the example of a 30 kHz Helmholtz dominant frequency in a particular ink jet apparatus, a subharmonic frequency would result in drive pulse widths which would be very large, causing an undesirable reduction in the usable print frequency of the particular device or ink jet apparatus. Accordingly, the present inventors tested an ink jet apparatus similar to the illustrative device but having a smaller ink chamber 200 (relatively lower compliance) for providing a Helmholtz resonant frequency of about 100 kHz. The method of the present invention operated this device with satisfactory printing using multipulses having a 30 microsecond periodicity, corresponding to the third subharmonic of the 100 kHz Helmholtz dominant resonant frequency. Multipulses having a periodicity made subharmonic to 100 kHz, for example of 20 kHz were tested, but performance at this subharmonic level was found to be relatively poor.

Figure 7:
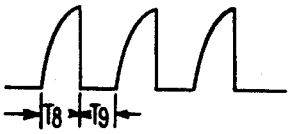
FIG. 7 shows a quarter-wave sinusoidal waveform for electrical pulses of a fourth embodiment of the invention.
Figure 8:
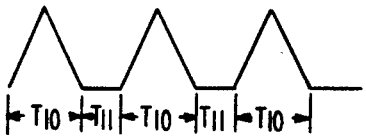
FIG. 8 shows a sawtooth waveform for a fifth embodiment of the invention.
Figure 9:
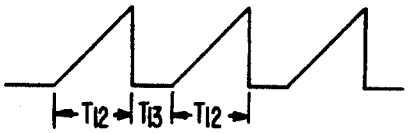
FIG. 9 shows a triangular waveform for electrical pulses of a sixth embodiment of the invention.
Figure 10:
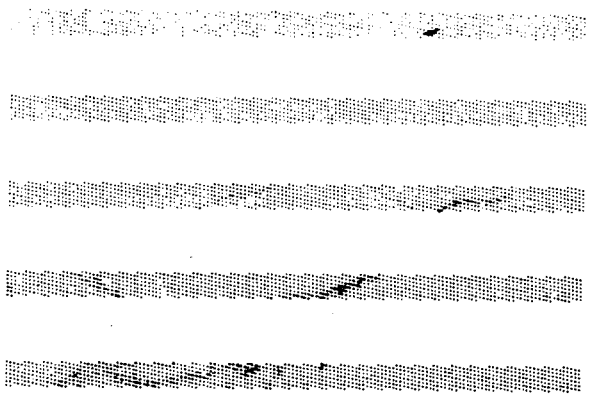
FIG. 10 shows printouts (A) through (F) obtained from the illustrative ink jet device using the method of the present invention.

In FIG. 10, bands of successive dots were printed using a successively higher number of multipulses for printing each dot in the bands shown in views (A) through print (F), respectively. The multipulses used in producing the bands of dots in FIG. 10 were quarter-wave sinusoids as shown in FIG. 7, with pulse times $T_8$ and dead times $T_9$ each of 15 microseconds. The voltage amplitude of the pulses was held constant at about 33 volts. In the band of dots view (A) only one such pulse was used for obtaining the dots shown. The dots of the band shown in view (B) were produced over the same cycle time as those in view (A) but two multipulses were used for producing each dot of the former rather than one. Similarly, the dots of bands shown in views (C) through (F) were produced using 3, 4, 5 and 6 multipulses, respectively, through an equivalent cycle of time for printing each dot. Accordingly, as would be expected, the bands of view (A) through (F) are successively bolder because of the successively greater dot size obtained via the multipulsing method of the present invention.

Similar multipulses were used in producing the font sets of successively greater boldness in views (A) through (C) of FIG. 11. The characters printed in view (A) required one drive pulse to produce each dot forming a given character, whereas two pulses were used for producing each one of the individual dots of the font of view (B), and three pulses were used in producing each individual dot forming the font characters of view (C).

In summation of the operation of the present invention, in operating an ink jet printing device to produce a printed dot upon a recording medium, a given period of time dependent upon the ink jet printing system is allotted for providing the ink droplet or droplets to print the dot on the recording medium. The boldness of a given dot can be controlled by controlling the volume of ink or number of ink droplets ejected from the ink jet device over the allotted time for producing that dot.

The present invention provides a method of operating an ink jet device using one or a multiple number of drive pulses for operating the device over a given dot production time for producing ink droplets, each of a known volume of ink, by carefully controlling the shape and periodicity of the drive pulses utilized, whereby the periodicity of the drive pulses utilized is made substantially equivalent to the dominant resonant frequency of the ink jet device.

The controller 261 can be provided by hardwired logic, or by microprocessor programmed for providing the necessary control functions, or by some combination of the two, for example. Note that a Wavetek Model 175 waveshape generator, manufactured by Wavetek, San Diego, Calif. was used by the present inventors to obtain the waveforms shown in FIGS. 1–9. In a practical system, a controller 261 would typically be designed for providing the necessary waveforms and functions, as previously mentioned, for each particular application.

Although particular embodiments of the present inventive method for operating an ink jet apparatus have been disclosed, other embodiments which fall within the true spirit and scope of the appended claims may occur to those of ordinary skill in the art.

What is claimed is:

1. A method for operating a drop-on-demand ink jet printing system in a resonant mode for providing high resolution printing upon a recording medium, said system comprising an ink jet having an ink cavity, an orifice communicating with said ink cavity, a transducer means in communication with said ink cavity, a source of electrical drive pulses or signals repeatable at a drop-on-demand drop production rate, said transducer means responsive to said electrical drive signals to fill said ink cavity and to force droplets of ink from said orifice, said method comprising the following steps:

(1) actuating the transducer means in response to said electrical signals for filling the cavity of ink during a "fill cycle";

(2) actuating the transducer means in response to said electrical signals for firing a droplet of ink from said orifice during a "fire cycle", said electrical signals, each signal being separated by dead time, corresponding to the dominant fluidic or mechanical resonant frequency of the ink jet printing system created by operating said transducer means; and (3) repeating steps (1) and (2) so as to merge droplets into a single drop prior to or at the time the drop reaches the print medium whereby each drop size can be controlled.

2. The method of claim 1 wherein said dominant resonant frequency is the Helmholtz frequency.

3. A drop-on-demand ink jet printing system operated in a resonant mode for providing igh resolution printing upon a recording medium, said system comprising an ink jet having an ink jet cavity, an orifice communicating with said ink cavity, a transducer means in communication with said cavity, a source of electrical drive pulses or signals repeatable at a drop-on-demand production rate, said transducer means responsive to said electrical drive signals to force a single droplet of ink from said orifice, the improvement comprising:

means for producing series of said electrical drive signals, each electrical drive signal separated by dead time, corresponding with the dominant resonant frequency or subharmonic thereof for said ink jet printing system; and said transducer means responsive to each of said electrical drive signals to produce an ink droplet having a controlled volume from said orifice, said ink droplets merging into a single drop of ink prior to or at the time the drop reaches the print medium for printing whereby each ink drop size can be controlled.

4. A drop-on-demand ink jet printing system of claim 3 wherein said electrical drive signals comprise a square wave.

5. a drop-on-demand ink jet printing system of claim 3 wherein said electrical drive signals comprise a sawtooth waveform.

6. A drop-on-demand ink jet printing system of claim 3 wherein said electrical drive signals comprise a triangular wave form.

7. The drop-on-demand ink jet printing system of claim 3 wherein said electrical drive signals comprises a half-wave sinusoidal waveform.

8. The drop-on-demand ink jet printing system of claim 3 wherein said electrical drive signals comprise a quarter-wave sinusoidal waveform.

9. The drop-on-demand ink jet printing system of claim 3 wherein said electrical drive signal comprises less than a quarter wave sinusoidal wave form.

10. The drop-on-demand ink jet printing system of claim 3 wherein said electrical drive signal comprises a wave form having an exponential leading edge and a step-like trailing edge.

11. The drop-on-demand ink jet printing system of claim 3 wherein said dominant resonant frequency is a fluidic or mechanical resonant frequency of said ink jet printing system.

12. The drop-on-demand ink jet printing system of claim 11 wherein said dominant resonant frequency is the Helmholtz resonant frequency.

13. A method of operating a drop-on-demand ink jet printing system in a resonant mode for providing high resolution printing upon a recording medium, said system comprising an ink jet having an ink cavity, an orifice communicating with said ink cavity, a transducer means in communication with said ink cavity, a source of electrical drive pulses or signals repeatable at a drop-on-demand production rate, responsive to said electrical drive signals to force droplets of ink from said orifice, said method comprising:

operating said transducer means to produce a dominant resonant frequency within said ink cavity;

repeatedly producing series of said electrical drive signals, each of said series being produced at a drop-on-demand production rate and each of signals within said series being separated by dead time, and having a repetition rate substantially equal to the dominant resonant frequency of the ink jet printing system or a subharmonic thereof; and actuating said transducer means with each of said electrical drive signals to produce an ink droplet having a controlled volume from said orifice, said ink droplets merging into a single drop of ink prior to or at the time the drop reaches the print medium for printing whereby each drop size can be controlled.

14. A method of claim 13 wherein the dominant resonant frequency substantially corresponds with the dominant fluidic or mechanical resonant frequency of said ink jet printing system.

15. The method of claim 14 wherein the dominant resonant frequency comprises the Helmholtz resonant frequency.

* * * * *